US007728829B2

(12) United States Patent
Meados et al.

(10) Patent No.: US 7,728,829 B2
(45) Date of Patent: Jun. 1, 2010

(54) DISPLAY SYSTEM

(75) Inventors: David B Meados, Corvallis, OR (US); Stan E Leigh, Corvallis, OR (US); Jamie Moore, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1172 days.

(21) Appl. No.: 11/332,389

(22) Filed: Jan. 13, 2006

(65) Prior Publication Data

US 2007/0164944 A1 Jul. 19, 2007

(51) Int. Cl.
*G09G 5/00* (2006.01)

(52) U.S. Cl. ..... 345/204; 345/205; 345/206; 345/209; 345/213

(58) Field of Classification Search ..... 345/1.1, 345/3.1, 6, 7, 10, 31, 39, 76, 84–87, 94, 108, 345/204, 210, 213, 506, 530, 537, 587, 671, 345/690; 353/31; 348/221.1, 771, 231.99, 348/333.1, 742, 513, 207, 229.1, 231.3, 607, 348/333.02, 333.04, 223.1; 250/201.3; 358/474; 396/234

See application file for complete search history.

(56) References Cited

U.S. PATENT DOCUMENTS 4,110,790 A 8/1978 Wheeler
4,947,253 A 8/1990 Neal
5,142,365 A 8/1992 Lim et al.
5,258,856 A * 11/1993 Shinada ..... 358/474
5,638,138 A 6/1997 Hickman
5,886,675 A * 3/1999 Aye et al. ..... 345/7
6,248,988 B1 * 6/2001 Krantz ..... 250/201.3
6,463,173 B1 10/2002 Tretter
6,466,185 B2 * 10/2002 Sullivan et al. ..... 345/6
6,505,002 B2 * 1/2003 Fields ..... 396/287
6,771,320 B2 8/2004 Choi
6,870,567 B2 * 3/2005 Funston et al. ..... 348/333.04
7,030,911 B1 * 4/2006 Kubo ..... 348/221.1
7,050,122 B2 * 5/2006 Gibbon et al. ..... 348/771
7,061,450 B2 * 6/2006 Bright et al. ..... 345/7
7,148,923 B2 * 12/2006 Harper et al. ..... 348/229.1
7,262,765 B2 * 8/2007 Brown et al. ..... 345/207
7,398,016 B2 * 7/2008 Cheng ..... 396/234
2002/0039137 A1 * 4/2002 Harper et al. ..... 348/207
2002/0080246 A1 * 6/2002 Parulski ..... 348/225
2002/0113752 A1 * 8/2002 Sullivan et al. ..... 345/6
2002/0158814 A1 * 10/2002 Bright et al. ..... 345/7
2003/0210337 A1 * 11/2003 Hall ..... 348/231.99
2004/0001184 A1 * 1/2004 Gibbons et al. ..... 353/31
2004/0201766 A1 * 10/2004 Funston et al. ..... 348/333.02
2005/0156871 A1 7/2005 Ikeda
2006/0164330 A1 * 7/2006 Bright et al. ..... 345/7
2007/0104475 A1 * 5/2007 Cheng ..... 396/234
2008/0062161 A1 * 3/2008 Brown et al. ..... 345/207

* cited by examiner

*Primary Examiner*—Prabodh M Dharia

(57) ABSTRACT

One embodiment of a display system includes a control module that controls an adjustable aperture based on a calculated aperture setting and that applies a calculated gain setting to a set of frame data to define a modified set of frame data, an image analysis module that calculates a gain setting and an aperture setting for said set of frame data and forwards said calculated gain setting and said aperture setting to said control module, and a frame data buffer that stores said set of frame data during calculation by said image analysis module.

20 Claims, 2 Drawing Sheets

DISPLAY SYSTEM

DISPLAY SYSTEM

Display systems may display a viewable image that does not effectively utilize the full dynamic range and contrast ratio range of the display system. Improving the utilization of the dynamic range and contrast ratio range of a display system may improve the viewable image displayed by the display system.

DETAILED DESCRIPTION OF THE DRAWINGS

Figure 1:
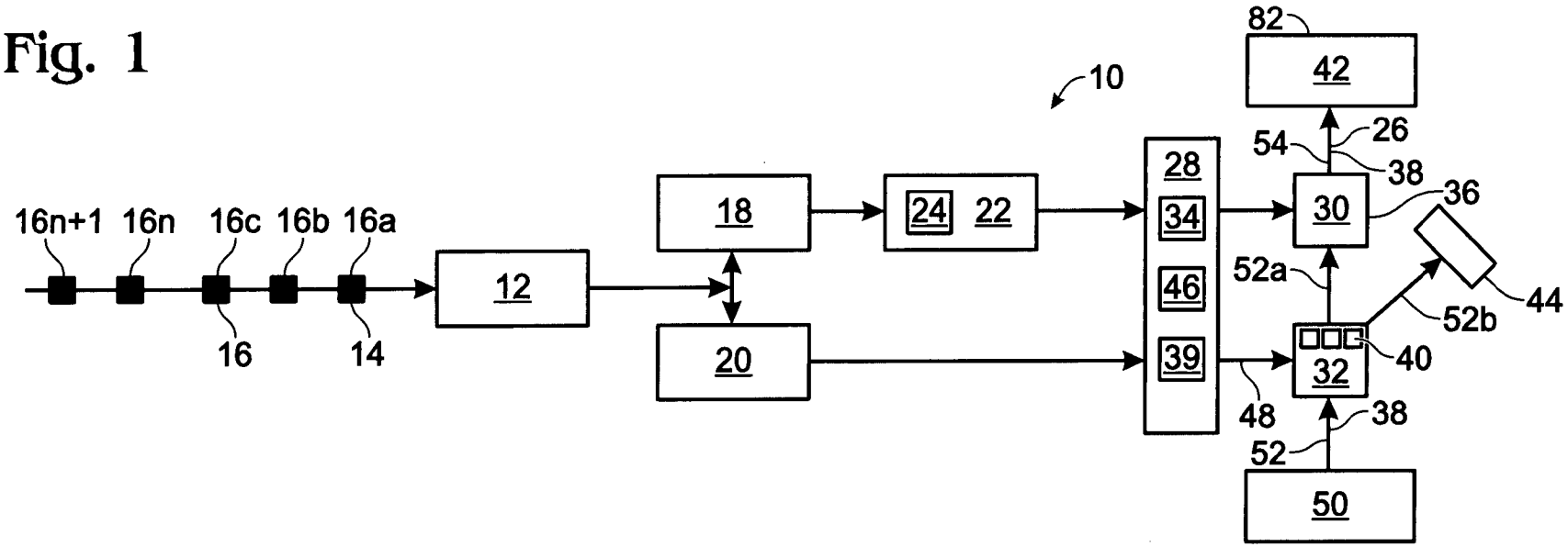
FIG. 1 represents a schematic view of a display system according to one embodiment of the present invention.

FIG. 1 represents a schematic view of a display system 10 according to one embodiment of the present invention. Display system 10 may include a data input module 12 that receives input data 14. Input data 14 may comprise an electronic video data stream including sequential sets of frame data, shown schematically as 16*a*, 16*b* and 16*c* through 16*n*+1. Each set of frame data 16 may include, for example, three color channels, such as red, blue and green (RBG). Each color channel may include eight bytes per channel, for example, which may yield 256 code values (zero to 255) per channel. The input data 14 may also include, for example, 124 mega pixels per frame of information transmitted at a speed of sixty frames per second. Accordingly, input data 14 may include large amounts of data input to data input module 12. In other embodiments, other types and amounts of data may be transmitted to data input module 12, for example, other color space, resolution, frame rate and bit depth values or types may be utilized.

Input module 12 may be electronically connected to both an image data capture module 18 and to a frame storage buffer module 20 such that input module 12 transmits input data 14, including a set of frame data 16, to both capture module 18 and to frame storage buffer module 20.

Image data capture module 18 may be electronically connected to an image analysis module 22 such that image data capture module 18 transmits input data 14, including set of frame data 16, to image analysis module 22. Image analysis module 22 may include machine operable instructions 24, such as software code. Instructions 24 may operate to analyze set of frame data 16 to determine a gain setting and an aperture setting for set of frame data 16 to increase the dynamic range and contrast ratio range of a set of displayed frame data 26 displayed by display system 10 and corresponding to set of frame data 16. In one embodiment, image analysis module 22 may calculate a gain setting and an aperture setting as set forth in U.S. Pat. No. 6,463,173, issued on Oct. 8, 2002 to Daniel R. Tretter, assigned to Hewlett-Packard Company, and entitled SYSTEM AND METHOD FOR HISTOGRAM-BASED IMAGE CONTRAST ENHANCEMENT, wherein such patent is hereby incorporated in its entirety by reference herein.

Determining or calculating a gain setting or settings may be defined as applying a set of gain values to define a tone curve. The actual algorithm or algorithms utilized to calculate the gain setting, wherein many different types of algorithms may be utilized, may involve applying a different gain value to each individual pixel in the image based on the luminance value of the individual pixel. In one simple algorithm this may include applying a single, identical gain value to each pixel. More complex algorithms may involve applying hundreds or more slightly different gain values to the pixels, wherein each individual gain setting value is applied to a corresponding one of the different pixels. In many cases the algorithms attempt to match the average luminance of the frame to the attenuation factor applied by an adjustable aperture 30 such that the overall luminance for the frame remains approximately constant. The single or multiple gain settings that may be applied to individual pixels of a frame are referred to collectively herein as a "gain" or a "gain setting" for that frame. Accordingly, a "gain setting" as defined herein may include one or more different gain values applied to pixels of a single frame.

Image analysis module 22 may be electronically connected to a control module 28 that may be operatively connected to an adjustable aperture 30 and to an image modulator 32. Control module 28 may include a mechanical motor 34 that mechanically adjusts adjustable aperture 30 (see FIG. 2) to define an aperture size 36 (see FIG. 2) that corresponds to the aperture setting calculated by image analysis module 22 for a particular set of frame data 16. Thereafter, adjustable aperture 30 may be adjusted to define another aperture size that corresponds to the aperture setting calculated by image analysis module 22 for a corresponding another set of frame data. Accordingly, adjustable aperture 30 may be continually adjusted during transmission of a video image, for example, through display system 10 to control an amount of light transmitted along a projection path 38 wherein the sequential transmission of light through adjustable aperture 30 corresponds to sequential sets of frame data, such as sets of data 16*a*, 16*b*, 16*c* through 16*n*+1.

Control module 28 may also include a controller 39 that may electrostatically control individual pixels 40, for example, of image modulator 32. Image modulator 32 may include hundreds, thousands, or more, of individual pixels 40, such as movable micromirrors, which may each be controlled by controller 39 to move between an active or "on" state and an inactive or "off" state. In the "on" state an individual pixel 40 may be positioned to reflect light to an imaging region 42 and in the "off" state, an individual pixel 40 may be positioned to reflect light to a light dump 44.

Control module 28 may further include a controller 46 that may apply the gain setting calculated by image analysis module 22 to a set of frame data 16. In particular, frame storage buffer module 20 may be electronically connected to control module 28 such that frame storage buffer module 20 transmits a set of frame data 16 to control module 28. Controller 46 then applies the gain setting calculated by image analysis module 22 to set of frame data 16 and control module 28 thereafter transmits a second set of frame data 48 to image modulator 32, wherein second set of frame data 48 corresponds to set of frame data 16, having the gain setting applied thereto. In other words, the control module may receive the frame data and the gain data, apply the gain data to the frame data, and then pass the modified or second set of frame data 48 to the modulator 32.

Still referring to FIG. 1, display system 10 may further include a light source 50 that may project a light beam 52 along projection path 38, wherein light beam 52 may reflect off image modulator 32 and may extend through adjustable aperture 30. Adjustable aperture 30 may be positioned anywhere along projection path 38. In one embodiment, adjustable aperture 30 may be positioned in an end region 54 of projection path 38, such as downstream of image modulator 32, so as to reduce unwanted distortion of light beam 52 as it passes through adjustable aperture 30.

Figure 2:
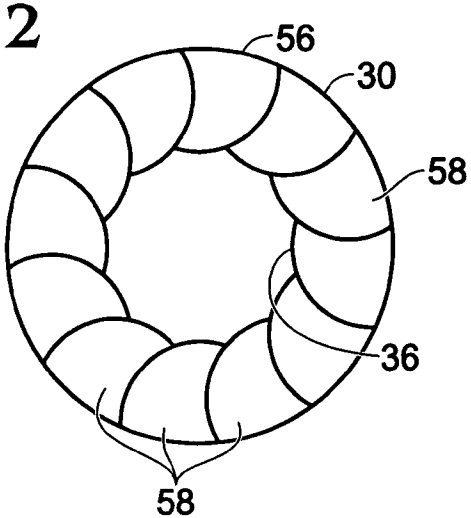
FIG. 2 represents a schematic front view of an adjustable aperture according to one embodiment of the present invention.

FIG. 2 represents a schematic front view of an adjustable aperture 30 according to one embodiment of the present invention. In this embodiment, adjustable aperture 30 may be a mechanically adjustable iris 56 that may define an adjustable aperture size 36 or opening. Adjustable iris 56 may include a plurality of overlapping leaves 58 that may each be manipulated by mechanical motor 34 to adjust aperture size 36 as applicable. In other embodiments, other types of adjustable apertures may be utilized, such as a "knife edge" aperture, as known in the art, which may be slidingly or rotatingly moved into and out of projection path 38 so as to block or partially block light from transmitting there along.

Figure 3:
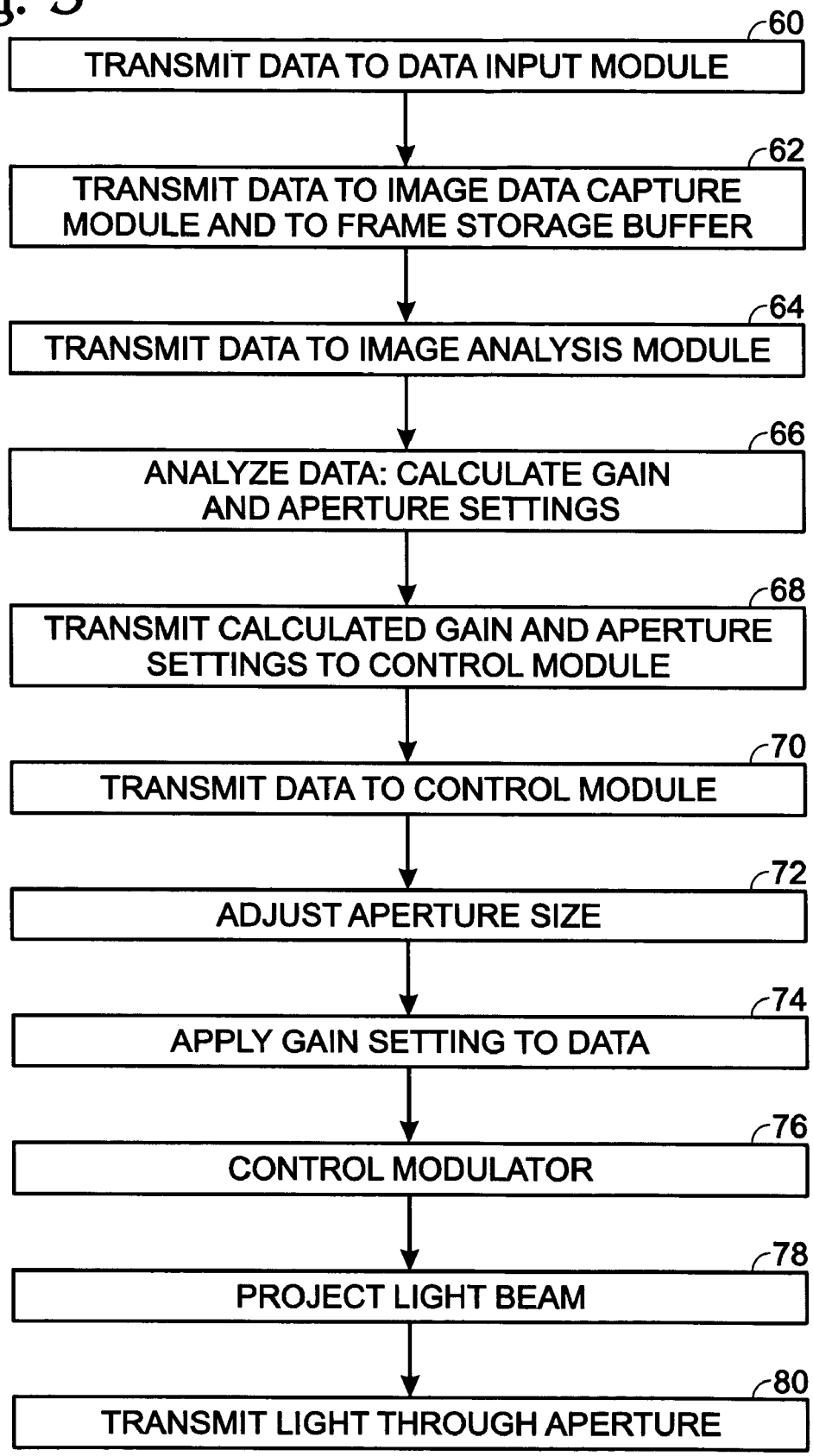
FIG. 3 is a flowchart of a method of making a display system according to one embodiment of the present invention.

FIG. 3 is a flowchart of a method according to one embodiment of the present invention. In step 60 a set of frame data 16 may be transmitted to data input module 12. Set of frame data 16 may be part of a video stream of data, for example, such as a live broadcast, a video, a computer monitor display, or the like.

In step 62 data input module 12 transmits set of frame data 16 to both image data capture module 18 and to frame storage buffer module 20. Set of frame data 16 is stored within frame storage buffer module 20 during calculation by image analysis module 22.

In step 64 image data capture module 18 transmits set of frame data 16 to image analysis module 22.

In step 66, image analysis module 22 analyzes set of frame data 16 and calculates a corresponding gain setting and a corresponding aperture setting that may increase utilization of the dynamic range and contrast ratio of a display to improve the viewable image displayed by the display system 10. The method of calculating the gain setting and the aperture setting, in one embodiment, is set forth in U.S. Pat. No. 6,463,173, issued on Oct. 8, 2002 to Daniel R. Tretter, listed above.

In step 68 image analysis module 22 transmits the calculated gain setting and the calculated aperture setting to control module 28.

In step 70 frame storage buffer module 20 transmits set of frame data 16 to control module 28.

In step 72 control module 20 operates mechanical motor 34 to adjust a size 36 of adjustable aperture 30 to correspond to the aperture setting calculated in step 66.

In step 74 control module 20 operates controller 46 to apply the calculated gain setting to set of frame data 16 to form second set of frame data 48, wherein second set of frame data 48 is set of frame data 16 having the calculated gain setting applied thereto. As discussed previously, the calculated "gain setting" may include a unique gain value for each pixel of the modulator array for each individual set of frame data. The gain setting calculated in step 66 is applied to the set of frame data 16 from which the gain setting was calculated, instead of to a subsequent set of frame data. Applying the calculated gain setting to the set of frame data 16 from which the gain setting was calculated increases the quality of the viewable image projected from display system 10 because there is a direct correlation between the gain setting and the data to which it is applied. Applying a gain setting to a completely different set of data from which the gain setting was calculated may not provide an improved contrast ratio within the image because the gain setting may be inapplicable to the data.

In step 76 control module 20 operates controller 39 to position each of individual pixels 40 of image modulator 32 in a desired "on" or "off" position, based on the information contained within second set of frame data 48, which corresponds to set of frame data 16 having the calculated gain setting applied thereto.

In step 78 light source 50 projects light beam 52 along projection path 38 and toward image modulator 32. Individual activated ones of pixels 40 reflect corresponding portions of light beam 52 as a reflected light beam 52*a* along projection path 38. An unused portion 52*b* of light beam 52 that is reflected by unactivated ones of pixels 40 is reflected to light dump 44.

In step 80 reflected light beam 52*a* is transmitted through adjustable aperture 30 and to imaging region 42 to provide a viewable image 82 having improved utilization of the dynamic range and contrast ratio range of display system 10 such that viewable image 82 may have improved contrast when compared to an image projected by a display system that does not utilize a gain setting and an aperture setting of the present invention. Moreover, viewable image 82 is created utilizing a gain setting and an aperture setting that are calculated based on the set of frame data that was utilized to create viewable image 82. Accordingly, there is a direct correlation between the gain and the aperture settings and the image itself. In this manner, an improved viewable image is consistently and continuously provided having contrast differences that are more discernable to the human eye than images having a gain setting calculated for a previous set of frame data.

The process may then be repeated, beginning at step 60, for subsequent sets of frame data, in a looping or continuous manner.

The foregoing description of embodiments of the invention have been presented for purposes of illustration and description. It is not intended to be exhaustive or to limit the invention to the precise form disclosed, and modifications and variation are possible in light of the above teachings or may be acquired from practice of the invention. The embodiments were chosen and described in order to explain the principles of the invention and its practical application to enable one skilled in the art to utilize the invention in various embodiments and with various modification as are suited to the particular use contemplated. It is intended that the scope of the invention be defined by the claims appended hereto and their equivalents.

We claim:

1. A display system, comprising:

a control module that controls an adjustable aperture based on a calculated aperture setting and that applies a calculated gain setting to a set of frame data to define a modified set of frame data;

an image analysis module that calculates a gain setting and an aperture setting for said set of frame data and forwards said calculated gain setting and said aperture setting to said control module; and a frame data buffer that stores said set of frame data during calculation by said image analysis module.

2. The system of claim 1 further comprising an image modulator that receives said modified set of frame data from said control module, and outputs a set of viewable image data, wherein said set of viewable image data corresponds to said set of frame data having said calculated gain setting applied thereto.

3. The system of claim 1 further comprising an adjustable aperture that is mechanically adjusted to said calculated aperture setting by said control module to adjust an amount of light output therethrough, wherein light corresponding to said modified set of frame data is projected through said adjustable aperture.

4. The system of claim 1 further comprising an image data capture module that receives said set of frame data and forwards said set of frame data to said image analysis module.

5. The system of claim 4 further comprising an input module that forwards said set of frame data to said image data capture module and to said frame data buffer.

6. The system of claim 1 wherein said image analysis module calculates a gain setting and an aperture setting for sequential sets of frame data and sequentially forwards a calculated gain setting and an aperture setting to said control module for each of said sequential sets of frame data.

7. The system of claim 6 wherein said sequential sets of frame data comprise a video input.

8. The system of claim 1 wherein said image analysis module calculates said gain setting and said aperture setting to increase a contrast ratio between pixel values of said set of frame data.

9. The system of claim 1 wherein said calculated gain setting and said calculated aperture setting are applied by said control module to said set of frame data from which said calculated gain setting and said calculated aperture setting are calculated.

10. A method of controlling a contrast ratio of an image, comprising:

receiving an image frame data;

routing said image frame data to both an image analysis module and to a frame buffer;

conducting an image analysis of said image frame data by said image analysis module to calculate a gain setting; and applying said gain setting to said image frame data of said frame buffer to control a contrast ratio of said image frame data.

11. The method of claim 10 further comprising:

conducting an image analysis of said image frame data by said image analysis module to calculate an aperture setting;

adjusting an adjustable aperture based on said calculated aperture setting; and projecting light that corresponds to said image frame data through said adjustable aperture.

12. The method of claim 10 further comprising routing said image frame data to an image data capture module prior to routing said image frame data to said image analysis module.

13. The method of claim 10 wherein said applying said gain setting to said image frame data of said frame buffer to control a contrast ratio of said image frame data comprises altering said image frame data with said gain setting to define a viewable frame data and reflecting light from said image modulator that correlates with said viewable frame data.

14. The method of claim 13 further comprising displaying said viewable frame data on said imaging region, wherein said viewable frame data corresponds to said image frame data having said gain setting applied thereto.

15. The method of claim 13 wherein said modulator comprises a digital micromirror array.

16. The method of claim 10 wherein said conducting an image analysis of said image frame data by said image analysis module to calculate a gain setting comprises executing machine operable computer instructions to increase an overall dynamic range of light utilized by said image frame data.

17. An image projection apparatus, comprising:

an image modulator that outputs a viewable image having a controlled contrast ratio;

a set of machine operable instructions that calculates a gain setting and applies said gain setting to a set of frame data to define a modified set of frame data, and that transmits said modified set of frame data to said modulator to produce said viewable image; and an electronic buffer that stores said set of frame data during calculation of said gain setting by said machine operable instructions, wherein said electronic buffer sends said set of frame data to said set of machine operable instructions after calculation of said gain setting.

18. The apparatus of claim 17 further comprising an adjustable aperture, a set of machine operable instructions that calculates an aperture setting that is applied to said adjustable aperture to produce said viewable image from said set of frame data, and a control device that applies said aperture setting to said adjustable aperture.

19. The apparatus of claim 17 further comprising a control device that controls activation of pixels of said modulator based on said modified set of frame data, and a light source that produces a light beam that is reflected by said image modulator to produce said viewable image.

20. The apparatus of claim 17 further comprising a video input splitter that forwards said image frame data to said set of machine operable instructions and to said electronic buffer.

* * * * *